US010563434B2

(12) United States Patent
Reddmann

(10) Patent No.: US 10,563,434 B2
(45) Date of Patent: Feb. 18, 2020

(54) LOCKING UNIT FOR A MOTOR VEHICLE

(71) Applicant: KIEKERT AG, Heiligenhaus (DE)

(72) Inventor: Uwe Reddmann, Essen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 321 days.

(21) Appl. No.: 15/028,513

(22) PCT Filed: Oct. 13, 2014

(86) PCT No.: PCT/DE2014/100357
§ 371 (c)(1),
(2) Date: May 5, 2016

(87) PCT Pub. No.: WO2015/055176
PCT Pub. Date: Apr. 23, 2015

(65) Prior Publication Data

US 2016/0251877 A1 Sep. 1, 2016

(30) Foreign Application Priority Data

Oct. 14, 2013 (DE) ..... 10 2013 016 954
Nov. 28, 2013 (DE) ..... 10 2013 019 938

(51) Int. Cl.
*E05B 77/28* (2014.01)
*E05B 81/06* (2014.01)
(Continued)

(52) U.S. Cl.
CPC ..... *E05B 77/28* (2013.01); *E05B 77/48* (2013.01); *E05B 81/06* (2013.01); *E05B 81/16* (2013.01);
(Continued)

(58) Field of Classification Search
CPC ..... E05B 77/26; E05B 77/28; E05B 79/10; E05B 79/22; E05B 81/06; E05B 81/16;
(Continued)

(56) References Cited

U.S. PATENT DOCUMENTS 3,039,290 A * 6/1962 Johnstone ..... E05B 77/48 292/201
3,062,034 A 11/1962 Leslie
(Continued)

FOREIGN PATENT DOCUMENTS

CN 101223323 A 7/2008
CN 201187193 Y 1/2009
(Continued)

OTHER PUBLICATIONS

Machine Translation of DE102010035083A1 by Lexis Nexis Total Patent on May 4, 2016.
(Continued)

*Primary Examiner* — Christine M Mills
(74) *Attorney, Agent, or Firm* — Woodard, Emhardt, Henry, Reeves & Wagner, LLP

(57) ABSTRACT

The invention relates to a motor vehicle door lock, comprising a locking mechanism, an electric drive, a locking unit and a coupling lever, said coupling lever acting on the locking unit. The coupling lever can be actuated by the electric drive counter to the force of the spring. The locking unit has a control contour, the coupling lever cooperating with said control contour.

18 Claims, 4 Drawing Sheets

(51) Int. Cl.
*E05B 81/16* (2014.01)
*E05B 77/48* (2014.01)
*E05B 77/26* (2014.01)
*E05B 47/00* (2006.01)

(52) U.S. Cl.
CPC ..... *E05B 77/26* (2013.01); *E05B 2047/0081* (2013.01)

(58) Field of Classification Search
CPC ..... E05B 81/34; E05B 81/36; E05B 81/42; E05B 77/48; E05B 2047/0081; Y10T 292/1047; Y10T 292/108; Y10T 292/1082; Y10T 292/1048; Y10T 292/1077; Y10T 292/1079; Y10S 292/23
USPC ..... 292/216, 200, 201, 217, 197, 199, 292/DIG. 23
See application file for complete search history.

(56) References Cited

U.S. PATENT DOCUMENTS

| | | | | | |
|---|---|---|---|---|---|
| 3,200,657 | A * | 8/1965 | Barden | H01H 13/60 | 200/542 |
| 3,264,784 | A | 8/1966 | Fiala | | |
| 3,952,605 | A | 4/1976 | Little | | |
| 4,003,010 | A * | 1/1977 | Kuchuris | H01H 51/088 | 200/525 |
| 4,142,167 | A | 2/1979 | Little et al. | | |
| 4,252,351 | A | 2/1981 | Yoshino et al. | | |
| 4,314,217 | A * | 2/1982 | Krasser | D06F 37/42 | 335/168 |
| 4,454,776 | A * | 6/1984 | Barge | E05B 81/06 | 185/40 R |
| 4,643,710 | A * | 2/1987 | Troutner | A61M 39/28 | 292/201 |
| 4,712,817 | A * | 12/1987 | Grandjean | E05B 47/00 | 248/222.52 |
| 4,752,092 | A * | 6/1988 | Faust | E05B 83/24 | 292/201 |
| 4,762,348 | A * | 8/1988 | Matsumoto | E05B 81/06 | 292/201 |
| 4,904,006 | A * | 2/1990 | Hayakawa | E05B 81/06 | 292/201 |
| 4,934,746 | A * | 6/1990 | Yamada | E05B 81/06 | 292/201 |
| 6,540,270 | B1 * | 4/2003 | Reddmann | E05B 81/22 | 292/201 |
| 6,705,649 | B1 * | 3/2004 | Reddmann | E05B 81/06 | 292/201 |
| 9,275,782 | B2 * | 3/2016 | Gerovac | H01H 3/56 | |
| 9,434,434 | B2 * | 9/2016 | Ura | B62H 5/00 | |
| 2008/0217956 | A1 | 9/2008 | Gschweng | | |
| 2011/0187132 | A1 * | 8/2011 | Scholz | E05B 81/20 | 292/226 |

FOREIGN PATENT DOCUMENTS

| | | | | | |
|---|---|---|---|---|---|
| CN | 201198687 | Y | | 2/2009 | |
| CN | 102797392 | A | | 11/2012 | |
| DE | 16 78 086 | A | | 7/1971 | |
| DE | 2533365 | | | 2/1976 | |
| DE | 3049120 | A1 | | 7/1982 | |
| DE | 102010035083 | A1 | | 2/2012 | |
| EP | 0684356 | A1 | * | 11/1995 | E05B 81/25 |
| FR | 1584541 | A | * | 12/1969 | E05B 77/48 |
| FR | 1584541 | A | | 12/1969 | |
| JP | 2012246657 | A | | 12/2012 | |

OTHER PUBLICATIONS

Machine Translation of DE3049120A1 by Lexis Nexis Total Patent on May 4, 2016.
Machine Translation of FR1584541A by Lexis Nexis Total Patent on May 4, 2016.
Written Opinion dated Jan. 16, 2015 in related PCT/DE2014/100357.
Chinese Office Action and English translation issued in related CN201480067780.X dated Apr. 26, 2017.
Machine translation of CN102797392A by Patent Translate European Patent Office on Jun. 25, 2019 (pp. 48).
Machine translation of CN201187193Y by Patent Translate European Patent Office on Jun. 25, 2019 (pp. 15).
Machine translation of CN201198687Y by Patent Translate European Patent Office on Jun. 25, 2019 (pp. 9).
Machine translation of JP2012246657A by Patent Translate European Patent Office on Jun. 25, 2019 (pp. 36).
German Office Action issued in related DE 10 2013 019 938.7 dated Jan. 29, 2019 (pp. 25).
Machine translation of DE 1678085A by Patent Translate European Patent Office on May 28, 2019.

* cited by examiner

LOCKING UNIT FOR A MOTOR VEHICLE

BACKGROUND

The invention relates to a motor vehicle door latch, comprising a locking mechanism, an electric drive, a locking unit and a coupling lever, said coupling lever acting on the locking unit and in which the coupling lever can be actuated by the electric drive counter to the force of a spring, in particular a center-off spring.

A motor vehicle door latch contains in most cases a catch and a pawl with the pawl being able to stop the rotation of the catch. When the pawl is lifted off the catch, the locking mechanism is opened. This releases a previously retained locking bolt. In the closed state of the locking mechanism, the catch is pretensioned by the sealing pressure of the door seal and also contains a spring, acting on the catch in the direction of its opening position. The locking unit can be a central locking unit or a central locking unit combined with an electric opening or anti-theft lock or child-lock.

A locking unit, in particular a central locking unit, ensures that in its "locked" position, an associated actuating lever, for instance, an external actuating lever, is not operational. In this position, the locking mechanism cannot be opened by the external actuating lever. In contrast, the locking unit can be moved from a "locked" into an "unlocked" position, in most cases by means of an internal actuating lever so that, for instance, even with the motor vehicle door latch in the locked position, persons inside the motor vehicle are able to open the door from the inside. On the other hand, an anti-theft mechanism generally ensures that also the internal actuating lever remains without function in the position "anti-theft lock on". This means that in the position "anti-theft lock on", a motor vehicle door containing the motor vehicle door latch can neither be opened from the outside nor from the inside. The door can also not be unlocked from inside, using the internal actuating lever.

DE 10 2010 035 083 A1 discloses a motor vehicle door latch in which two latch functions are provided by a single drive, with the actuator that can be acted upon, containing a control contour. To reach the control contour very precise movement is required with very little play.

SUMMARY

The invention therefore has the task of providing a motor vehicle door latch of the said type, operating in a robust and reliable manner and ensuring a reliable insertion of the functions of the latch.

In order to solve this technical problem, the invention suggests uncoupling of the control contour from the locking element. The invention provides a motor vehicle door latch, comprising a locking mechanism, an electric drive. a locking unit and a coupling lever, in which the coupling lever acts on the locking unit, in which the coupling lever can be actuated counter the force of the centre-zero spring by means of the electric drive, in which the locking element contains a control contour and in which a coupling lever, preferably a push rod, cooperates with the control contour. The control contour contains characteristics with which the push rod can cooperate so that different positions can be assumed.

The locking unit is a functional unit carrying out at least one of the following functions:

Locking, in particular, central locking
Electric opening
Anti-theft protection and/or
Child lock In one embodiment of the invention, the control contour is part of a separate locking element. A locking lever is part of the locking element. The locking lever contains the control contour. The separate design of the locking lever provides an independent switching means, ensuring reliable functioning. In contrast to the known prior art, switching travel, torque and directions of movement can be definitively provided and set.

The locking element can be rotatably mounted, with one end position of the locking element determining an unlocked position and one end position determining a locked position. The locking element can move into two directions, attaining two different target, functional or end stops or end positions. One end position can, for instance, serve to unlock the motor vehicle door latch and one to lock said latch. It is advantageous that a function is clearly assigned to each end position.

The control contour on the locking element is designed in such a way that an end position is attained upon each actuation of the locking element by means of the coupling lever. The coupling lever acts between the electric drive and the locking lever and the coupling lever can be a push rod. The push rod can be designed to be retained in a guide, i.e. a guided push rod. The push rod moves the locking element to one of the two end positions. The push rod thus acts as a lever. A lever movement requires little force and also offers the advantage of considerable forces being generated, guarantying reliable functioning also under extreme conditions. It is furthermore advantageous that the direction of movement and predefinable torque paths and thus the achievable forces can be influenced by means of a push rod.

The control contour can be shaped like a pointed cone. With the push rod for actuating the locking element making contact with a different side of the cone in the respective end position, moving the locking element into its end position. The pointed side of the cone can be allocated to the push rod, i.e. the cone points in the direction of the push rod and/or of the electric drive. Using the angles on the cone, the actuating forces and paths achievable by the locking unit can be influenced in an advantageous manner. The control contour ends in a pointed shape at one end. This part of the control function functions as a locking element with the locking element being, for instance, part of an actuating chain. The coupling lever or push rod moved by the drive cooperates with the control contour and moves the locking element into an end position. In other words, as a result of the cooperation between the push rod and the angle of the cone of the control contour, forces, paths and speeds provided for locking, can be influenced and accurately stipulated.

Coupling lever and push rod are used as synonyms and both refer to the connection member or means for transferring a force or a torque from the electrical drive onto the locking element. The push rod can engage in a radius-shaped recess for rotating the locking element. For this purpose, the control contour contains circular-shaped indentations on both sides. The coupling lever can positively interlock in these indentations to move the locking element. The radius-shape recesses prevent the push rod from exceeding its travel and allow the force to be transferred without slipping, i.e. push rod and locking element positively interlock.

The coupling lever can be designed as a push rod and is preferably designed as a push rod guided at least partially. As pusher, the coupling lever transfers, for instance, the driving force onto the control contour in form of a linear movement. A rotating adjusting disk of the drive can, at the same time, cause a linear forward movement of the coupling lever whilst the spring element can be pretensioned. The drive can switch itself off at the reversal point of the actuating disk. Alternatively, the locking element forms a stop for the coupling lever and thus for the electric drive so that moving against a block serves as a control element for the electric drive. At the reversal point, the pretensioned spring element causes, for instance, the coupling lever to move linearly back to its starting position with the spring element relaxing, i.e. the adjusting disk is moved back to its starting position by means of the spring element.

Preferably, the control contour and/or the entire locking element are designed symmetrically. Depending on the design of the latch and the required adjustment paths for the function to be set using the locking element, an asymmetrical design can, however, also be advantageous. Also the recesses, i.e. the correlating elements of the control contour and push rod do not necessarily have to be symmetrical. It can be advantageous to design the push rod to have an arrow tip shape of which one side meets the side of the cone and the other side can engage in a notch or snap-in contour at one end of the control contour.

The coupling lever can be secured on a rotatably mounted actuating means of the drive, preferably a gear wheel or an actuating lever. The coupling lever is rotatably mounted on the toothed gear or actuating lever. As a result, the coupling lever is moved as a pusher in forward and backward movements and the coupling lever or push rod thus forms a pusher.

A spring element and preferably a centre-zero spring or also another return spring can act on the actuating means with the spring element holding the actuating means in a starting position. The starting position corresponds to the unconfirmed position of the coupling lever. The centre-zero spring or the return spring is relaxed in the starting position. From the starting position, the centre-zero spring acts as a return spring when the actuating means and thus also the coupling lever is moved. The centre-zero spring relaxes counter the direction of movement of the drive. As a result, the coupling slider is reset to its starting position after each actuation. When the motor is reactivated, a new function can be carried out without delay.

A further coupling lever can be mounted on the actuating means with the further coupling lever interacting with another control element so that a further latch function can be actuated. The further coupling lever can act in another direction and moves a control element having a different function. It is thus possible to actuate two different functions in the latch with one drive.

Other latch functions can include electric opening, anti-theft lock or child-lock. One of the following functions can at least be carried out by the latch in combination or alternatively, in particular by the locking unit of the invention: central locking, internal locking, external locking, electric opening, anti-theft lock, child-lock. The invention can therefore be used for numerous latch function combinations.

One example embodiment of the invention is shown in the drawing and is described in detail below.

In which:

DETAILED DESCRIPTION OF THE DRAWINGS

Figure 4:
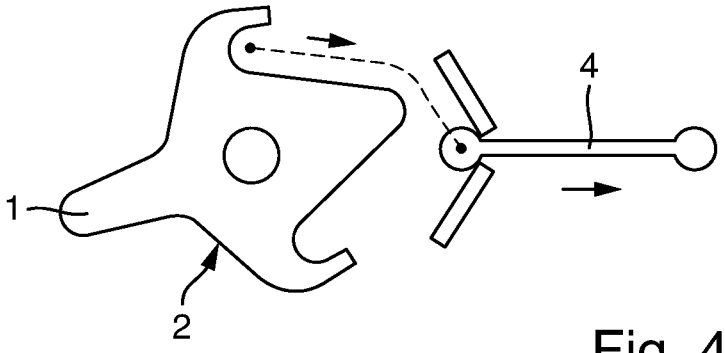
FIG. 4 shows the control element in its unlocked position with the coupling rod in its starting position and the push rod being acted upon by a gear wheel element.
Figure 6:
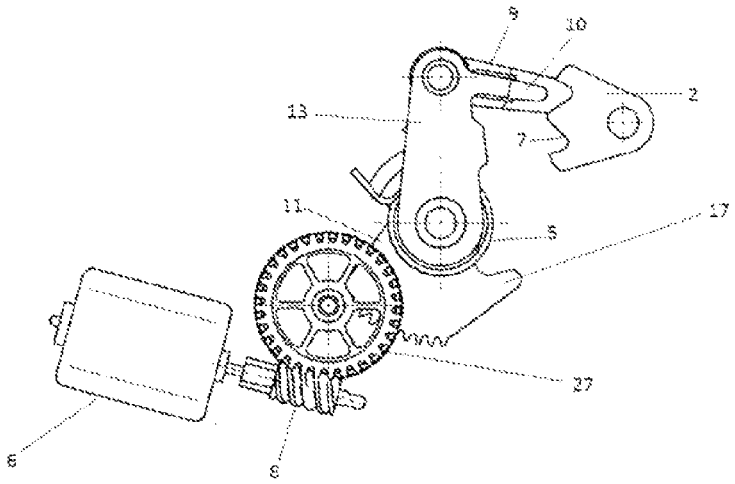
FIG. 6 shows the FIG. 5 locking unit in a neutral position.
Figure 7:
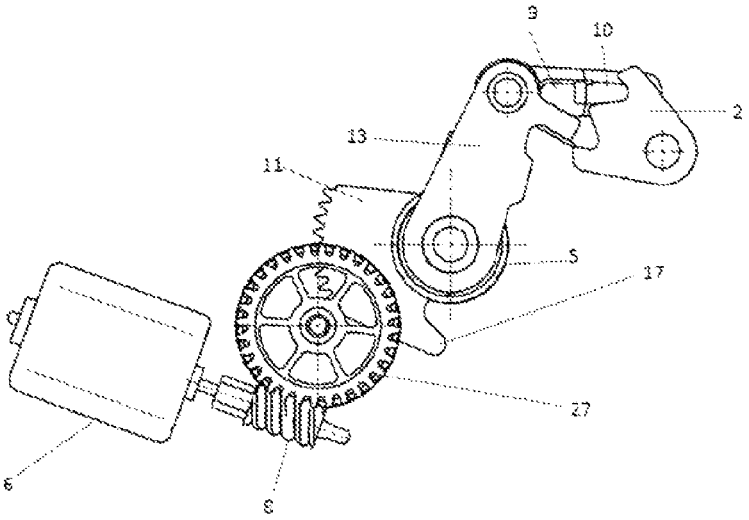
FIG. 7 shows the FIG. 5 locking unit moved.

FIG. 4, FIG. 6, FIG. 7 show a section of the motor vehicle door latch. The locking mechanism comprises the catch and pawl. The pawl must be released from the catch for the motor vehicle door latch to open. This is, for instance, achieved with the aid of the actuating lever. The starting point for this is a mechanical actuating lever chain.

Figure 1:
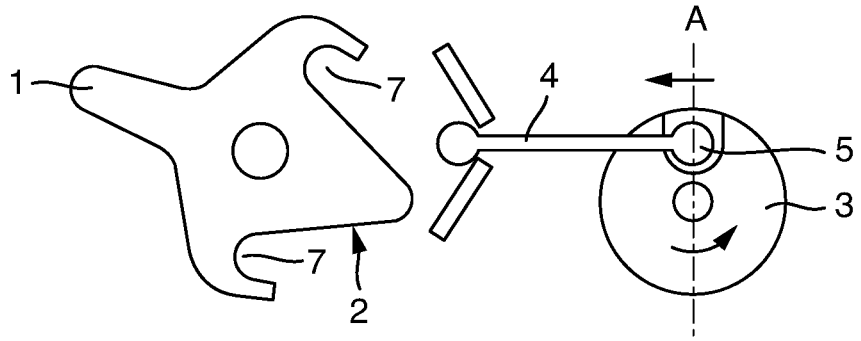
FIG. 1 shows the control element in its locked position with the coupling rod in its starting position and the push rod being acted upon by a gear wheel element.

In FIG. 1, the motor vehicle door latch is locked. The alignment of the locking lever 1 is predefined by the alignment of the locking element 2, whilst the push rod 4, acted upon by an actuating means 3—a gear wheel in this embodiment—is in starting position A. In addition, a spring element 5, in this case a centre-zero spring, acts on the actuating means 3 with the spring element 5 holding the actuating means 3 in the starting position of the push rod 4.

Figure 2:
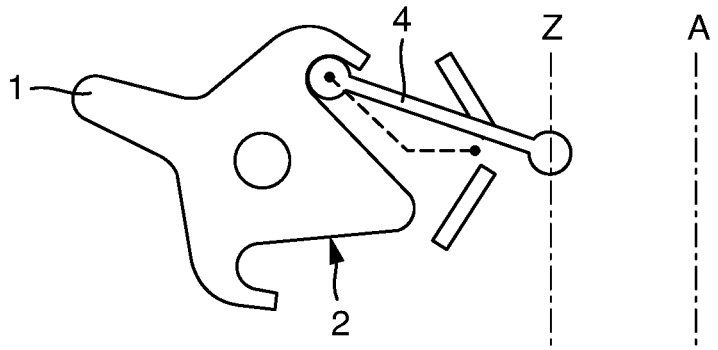
FIG. 2 shows the control element in its locked position with the coupling rod positively interlocking with a recess formed by a radius.

In FIG. 2, a push rod 4 is driven by a motor 6 unidirectional in the sense of a forward movement. The push rod 4 positively engages in a recess 7 formed as a radius with an interim position Z being attained. The spring element 5 is tensioned.

Figure 3:
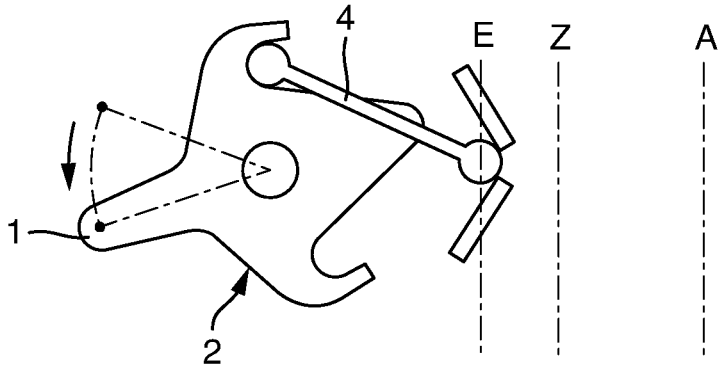
FIG. 3 shows the control element in its unlocked position with the coupling rod positively interlocking with a recess formed by a radius.

In FIG. 3, the motor still drives the push rod 4. Said rod rotates the locking element 2 into its other end position E, unlocked, so that the mechanical actuation chain from the triggering lever up to the internal or external actuation lever exists again. The latch can be opened using the internal or external actuation lever, i.e. the locking mechanism can be unlocked.

In FIG. 4 the locking element 2 remains in the unlocked position. The motor 6 is switched off at the reversal point. The spring element 5 pulls the push rod 4 back into its starting position A. The spring 5 relaxes, simultaneously moving the push rod 4 back into its starting position A. By uncoupling push rod 4 and locking element 2, the locking unit of the invention is able to actuate several functions in the latch with only one drive.

The drawings also show another embodiment of the invention which is explained in detail below.

Figure 5:
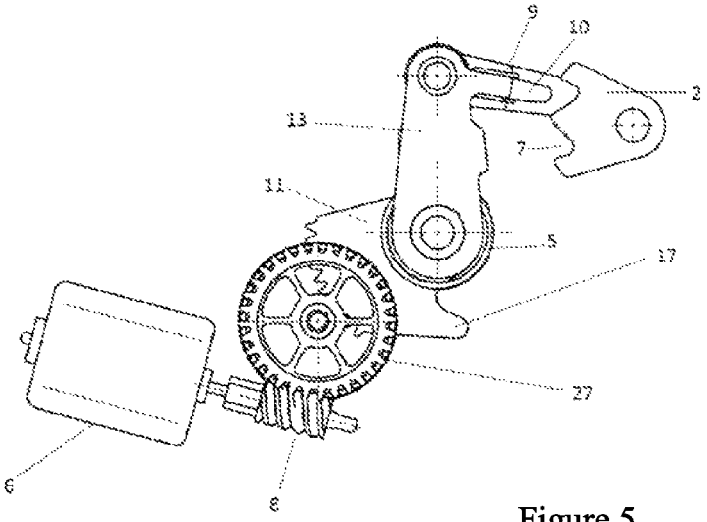
FIG. 5 shows the base position of a locking unit.

FIG. 5 shows the base position of the locking unit. The control or locking element 2 is in neutral position. The coupling rod, in this case a transmission lever 10, is in base position. The spring element 5 retains the actuating means—in this embodiment an actuating lever—in its starting position in relation to the actuating lever. The toothed segment 11, with a lever 17 being formed by the control contour, is in neutral position.

In FIG. 6 the control or locking element is in neutral position. The coupling rod, in this case a transmission lever 10, is in the base position. The spring element 5 retains the actuating means—in this embodiment an actuating lever 13—in its starting position in relation to the transmission lever 10. The lever of the toothed segment formed by the control contour was moved.

FIG. 7 shows the moved control or locking element 2. The coupling rod—in this case a transmission lever 10—is in its base position. The spring element 5 is tensioned. The toothed segment 11, with a lever 17 being formed by the control contour, is in neutral position.

The figures show a section of a motor vehicle door latch. The locking mechanism comprises the catch and pawl. The pawl must be released from the catch for the motor vehicle door latch to open. This is, for instance, achieved with the aid of the actuating lever. The starting point for this is a mechanical actuating lever chain, with the actuating lever chain in this embodiment being actuated by the lever-shaped control contour of the toothed segment 11.

FIG. 5 shows the motor vehicle door latch in its base position. The control or locking element 2 is in its neutral position. The coupling rod—in this case a transmission lever 10—is in its neutral base position. The transmission lever 10 is held in its base position by a return spring, the positioning spring 9. The positioning spring 9 rests against the actuating lever 13, arranged at a defined angle to the actuating lever. The actuating lever 13 and the toothed segment 11 are held in position by a spring element 5, a return spring. The spring element 5 is fixed to the below latch housing. The toothed segment is driven by a drive consisting of a gear wheel 27, worm 8 and motor 6.

During electric opening as shown in FIG. 6, the toothed segment is moved by the drive. The lever formed from the control contour can engage with the mechanical actuation chain. The spring element 5 is tensioned. The actuating lever 13, the positioning spring 9, the transmission lever 10 and the locking element 2 are still in their base position.

FIG. 7 shows a function, such as the central locking function. By means of the drive, the actuating lever 13 is moved out of its base position so that the transmission lever 10 positively engages in a recess 7 formed in a radius whilst the locking element 2 is tilted. This causes an actuation of a lever chain, actuating a function. This example embodiment shows that the locking unit of the invention is able to actuate several functions in the latch with only one drive.

The invention claimed is:

1. Motor vehicle door latch, comprising:

a locking mechanism, an electric drive, a rotatable actuating means rotated by the electric drive, a locking unit comprising a control contour, wherein the control contour has a base position and a moved position, a first coupling lever rotatably mounted on the rotatable actuating means, wherein the first coupling lever is adapted to act on the control contour of the locking unit, wherein the control contour defines a first recess that aligns with the first coupling lever in the base position and a second recess that aligns with the first coupling lever in the moved position and wherein operating the electric drive to rotate the rotatable actuating means moves the first coupling lever from the base position to the moved position or from the moved position to the base position, a spring that biases the first coupling lever away from the control contour, wherein operation of the electric drive rotates the rotatable actuating means and moves the first coupling lever to act on the control contour counter the biasing force of the spring.

2. Motor vehicle door latch according to claim 1, wherein the control contour is part of a second lever.

3. Motor vehicle door latch according to claim 2, wherein the locking unit is rotatably mounted, with a first end position of the locking unit determining a locked position and a second end position an unlocked position.

4. Motor vehicle door latch according to claim 3, wherein the control contour is designed in such a way that during each actuation of the locking unit by means of the first coupling lever, the first end position or the second end position is attained.

5. Motor vehicle door latch according to claim 4, wherein the control contour has a shape corresponding to a pointed cone; wherein the first coupling lever impinges on one side of the cone to actuate the locking unit in the respective end position and positively rotates the locking unit into the end position.

6. Motor vehicle door latch according to claim 3, wherein the control contour has a shape corresponding to a pointed cone; wherein the first coupling lever impinges on one side of the cone to actuate the locking unit in the respective end position and positively rotates the locking unit into the end position.

7. Motor vehicle door latch according to claim 6, wherein the first coupling lever engages in a radiused recess defined by the control contour in order to rotate the locking unit.

8. Motor vehicle door latch according to claim 7, wherein the first coupling lever is designed as a push rod guided at least in parts or as a transmission lever.

9. Motor vehicle door latch according to claim 8, wherein the rotatable actuating means is a gear wheel or an actuating lever.

10. Motor vehicle door latch according to claim 1, wherein a function of the locking unit is selected from the group consisting of an electric opening, an anti-theft lock, a child lock, a central locking, an internal locking and an external locking.

11. Motor vehicle door latch according to claim 1, wherein the first coupling lever is designed as a push rod guided at least in parts or as a transmission lever.

12. Motor vehicle door latch according to claim 1, wherein the rotatable actuating means is a gear wheel or an actuating lever.

13. Motor vehicle door latch of claim 1, further comprising:

a worm drive; and a gear wheel, wherein the electric drive rotates the worm drive which rotates the gear wheel which rotates the rotatable actuating means.

14. Motor vehicle door latch comprising:

a locking mechanism;

a locking unit comprising a control contour, wherein the control contour has a base position and a moved position;

an electric drive;

an actuating lever that is rotatable by the electric drive;

a coupling lever that is rotatably mounted on the actuating lever and is movable relative to the control contour to selectively act on the control contour, wherein the control contour defines a first recess that aligns with the coupling lever in the base position and a second recess that aligns with the coupling lever in the moved position and wherein operating the electric drive to rotate the rotatable actuating lever moves the coupling lever from the base position to the moved position or from the moved position to the base position; and a first spring that biases the actuating lever to retain the actuating lever in a starting position with the coupling lever spaced apart from the control contour, wherein the electric drive acts counter the biasing force of the first spring to bring the coupling lever into contact with the control contour.

15. Motor vehicle door latch of claim 14, further comprising a second spring that acts between the actuating lever and the coupling lever.

16. Motor vehicle door latch of claim 15, further comprising:

a worm drive; and a gear wheel, wherein the electric drive rotates the worm drive which rotates the gear wheel which rotates the actuating lever.

17. Motor vehicle door latch of claim 16, further comprising a toothed segment that is rotated by the gear wheel, wherein rotation of the toothed segment rotates the actuating lever.

18. Motor vehicle door latch comprising:

a locking mechanism;

a locking unit comprising a control contour;

an electric drive;

an actuating lever that is rotatable by the electric drive, wherein the actuating lever rotates about an actuating lever axis;

a coupling lever that is rotatably mounted on the actuating lever and is movable relative to the control contour to selectively act on the control contour, wherein the coupling lever rotates relative to the actuating lever about a coupling lever axis and wherein the coupling lever axis is radially spaced apart from the actuating lever axis; and a first spring that biases the actuating lever to retain the actuating lever in a starting position with the coupling lever spaced apart from the control contour, wherein the electric drive acts counter the biasing force of the first spring to bring the coupling lever into contact with the control contour.

* * * * *